US006163237A

United States Patent [19]

Toda et al.

[11] Patent Number: 6,163,237

[45] Date of Patent: Dec. 19, 2000

[54] DIELECTRIC FILTER AND DIELECTRIC DUPLEXER

[75] Inventors: Jun Toda; Hideyuki Kato, both of Ishikawa-ken; Haruo Matsumoto, Kanazawa, all of Japan

[73] Assignee: Murata Manufacturing Co., Ltd., Japan

[21] Appl. No.: 09/212,527

[22] Filed: Dec. 16, 1998

[30] Foreign Application Priority Data

Dec. 25, 1997 [JP] Japan ..... 9-356825

[51] Int. Cl.[7] ..... H01P 1/20; H01P 3/08; H01P 5/12

[52] U.S. Cl. ..... 333/206; 207/127; 207/134

[58] Field of Search ..... 333/125, 126, 333/127, 129, 132, 134, 202, 206, 207

[56] References Cited

U.S. PATENT DOCUMENTS

| | | | |
|---|---|---|---|
| 4,757,288 | 7/1988 | West | 333/206 |
| 5,537,082 | 7/1996 | Tada et al. | 333/202 |
| 5,929,725 | 7/1999 | Toda et al. | 333/206 |

FOREIGN PATENT DOCUMENTS

| | | |
|---|---|---|
| 0743696 | 11/1996 | European Pat. Off. . |
| 0124601 | 5/1988 | Japan . |
| WO 9702618 | 1/1997 | WIPO . |

OTHER PUBLICATIONS

Patent Abstracts of Japan, vol. 13, No. 155 (E–743), Apr. 14, 1989 & JP 63 312701 A (Murata Mfg Co Ltd) Dec. 21, 1988, abstract.

European Search Report dated Mar. 31, 1999.

*Primary Examiner*—Robert Pascal

*Assistant Examiner*—Patricia T. Nguyen

*Attorney, Agent, or Firm*—Ostrolenk, Faber, Gerb & Soffen, LLP

[57] ABSTRACT

The invention provides a dielectric filter, comprising: a dielectric block having substantially rectangular shape, said dielectric block including a first and a second opposed to each other and a third and a fourth opposed to each other and extending between said first and second surfaces; a plurality of through holes extending between said first and second surfaces; an inner conductor provided on an inner surface of said through holes except for a non-conductive portion, said non-conductive portion being disposed on said inner surface of said through holes in the vicinity of said first surface of said dielectric block; an outer conductor provided on said third and fourth surfaces of said dielectric block; and a line conductor provided on said first surface of said dielectric block, a part of said outer conductor provided on said third surface of said dielectric block and a part of said outer conductor provided on said fourth surface of said dielectric block being connected to each other via said line conductor; thereby a plurality of resonators comprising a combination of a TEM mode resonator and a TE mode resonator, and a combination of a TEM mode resonator or a TM mode resonator being provided.

6 Claims, 6 Drawing Sheets

DIELECTRIC FILTER AND DIELECTRIC DUPLEXER

BACKGROUND OF THE INVENTION

1. Field of the Invention

The present invention relates to a dielectric filter and a dielectric duplexer, and more specifically, to a dielectric filter and a dielectric duplexer for dual bands be used in communication devices, etc., for the microwave band and the millimeter wave band.

2. Description of the Related Art

A dual-band high frequency circuit part to be used for a communication device for the microwave band or the millimeter wave band has been constituted by combining two band pass filters 101,121 shown in FIGS. 10 and 11. The band pass filter 101 shown in FIG. 10 is provided with three resonators utilizing a TEM mode.

In FIG. 10, the high frequency circuit part comprises a dielectric block 102, through holes 103 in which an inner conductor is provided on an inner wall surface, electrode patterns 104 for regulating the respective resonance frequency of TEM mode resonators and the electromagnetic coupling therewith, an outer conductor 105 provided on an outer surface of the dielectric block 102 except for an open end surface 102*a*, and input/output electrodes 106 for TEM mode.

The band pass filter 121 shown in FIG. 11 is provided with three resonators utilizing a TE mode. In FIG. 11, the band pass filter is provided with a dielectric block 122, a line conductor 123 for TE mode coupling, outer conductors 124*a*, 124*b* which are provided on upper and lower surfaces of the dielectric block 122 and electrically connected to each other via the line conductor 123, and input/output electrodes 125 for TE mode.

Apart from the above described structure, in some cases the dual band high frequency circuit part comprises a band pass filter of one-input/two-output type which provides a duplexer.

However, in either case, there is enough problem that a space to be occupied by two band pass filters is required when the above described filters are mounted on a printed circuit board, etc.

To solve this problem, composite parts miniaturized by integrating the TEM mode band pass filter 101 and the TE mode band pass filter 121 which are illustrated in FIGS. 10 and 11 respectively, can be designed. However, simply integrating the TEM mode band pass filter 101 and the TE mode band pass filter 121 requires the line conductor 123 for the TE mode coupling to be disposed between the electrode patterns 104 formed on the open end surface 102*a* of the TEM mode band pass filter 101, and the electromagnetic coupling of the TEM mode resonators with each other is affected by the line conductor 123. Thus, it is difficult to independently design the TEM mode band pass filter and the TE mode band pass filter. In addition, the electrode patterns 104 are provided on the open end surface 102*a*, and the position where the line conductor 123 is formed is limited to a specific part of the open end surface 102*a*, raising a new problem that the resonance frequency of the TE mode resonator and the setting of the number of the resonators are restricted.

SUMMARY OF THE INVENTION

Preferred embodiments of the present invention are provided to overcome the above described problems, and provide a compact dielectric filter and a compact dielectric duplexer for dual bands with which a built-in resonator of each mode can be independently designed.

The preferred embodiment of the present invention provides a dielectric filter, comprising: a dielectric block having substantially rectangular shape, said dielectric block including first and second surfaces opposed to each other and third and fourth surfaces opposed to each other and extending between said first and second surfaces; a plurality of through holes extending between said first and second surfaces; an inner conductor provided on an inner surface of said through holes except for a non-conductive portion, said non-conductive portions being disposed on said inner surfaces of said through holes in the vicinity of said first surface of said dielectric block; an outer conductor provided on said third and fourth surfaces of said dielectric block; and a line conductor provided on said first surface of said dielectric block, a part of said outer conductor provided on said third surface of said dielectric block and a part of said outer conductor provided on said fourth surface of said dielectric block being connected to each other via said line conductor; whereby a plurality of resonators comprising a combination of a TEM mode resonator and a TE mode resonator, or a combination of a TEM mode resonator and a TM mode resonator, are provided.

In the above described dielectric filter, instead of the line conductor, at least one of a coupling means and a coupling groove may be provided. Said coupling means extends between said third and fourth surfaces of said dielectric block, and a part of said outer conductor provided on said third surface of said dielectric block and a part of said outer conductor provided on said fourth surface of said dielectric block are connected to each other via said coupling means. Said coupling groove is disposed on said first and second surfaces of said dielectric block and extends between said third and fourth surfaces of said dielectric block; thereby a plurality of resonators comprising a combination of a TEM mode resonator and a TE mode resonator, or a combination of a TEM mode resonator or a TM mode resonator being provided.

The above described coupling means may comprises a through hole for coupling extending between said third and fourth surfaces of said dielectric block and an inner conductor provided on an inner surface of the through hole. A part of said outer conductor provided on said fourth surface of said dielectric block are connected to each other via said inner conductor.

In the above described dielectric filter, said non-conductive portion may be also disposed on said inner surface of said through holes in the vicinity of said second surface of said dielectric block.

The above described dielectric filter may further include fifth and sixth surfaces opposed to each other and extending between said first and second surfaces; and input/output external electrodes may be provided on said fifth and sixth surfaces of said dielectric block.

The above described structure of the dielectric filter may be applied to a dielectric duplexer as well.

According to the above structure, a plurality of through holes and their inner conductors, together with the outer conductors and the dielectric block, constitute a plurality of TEM mode resonators. On the other hand, the line conductor, the coupling means such as the through hole for coupling, and the groove function as the coupling susceptance, while the outer conductors and the dielectric block constitute a plurality of TE mode resonators or TEM mode resonators divided by the line conductor, the coupling means and the groove.

Further, the inner conductors provided on the inner wall surface of the through holes are also provided with the non-conductive portion in the vicinity of the second surface of the dielectric block, and the TEM mode resonator becomes the resonator of ½ wavelength.

Because the non-conductive portion to regulate the respective resonance frequencies of the TEM mode dielectric resonators and the electromagnetic coupling therewith is provided in the through holes, an electromagnetical affection by the line conductors, coupling means and the groove is suppressed. As a result, a compact dielectric filter or dielectric duplexer for dual band capable of independently designing a built-in resonator of each mode, can be obtained.

Other features and advantages of the present invention will become apparent from the following description of preferred embodiments of the invention which refers to the accompanying drawings, wherein like reference numerals indicate like elements to avoid duplicative description.

DETAILED DESCRIPTION OF THE PREFERRED EMBODIMENTS

Figure 1:
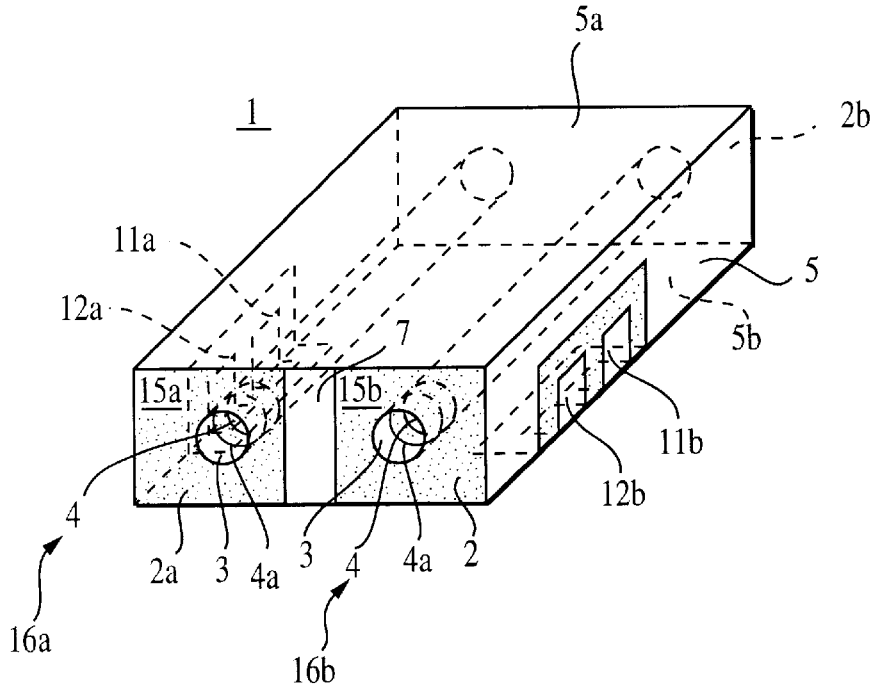
FIG. 1 is a perspective view illustrating a first preferred embodiment of a dielectric filter of the present invention.
Figure 2:
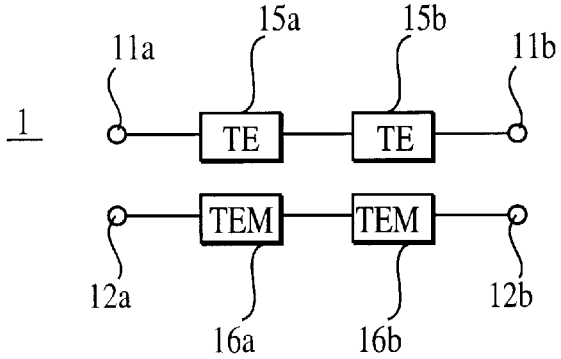
FIG. 2 is an electric equivalent circuit of the dielectric filter illustrated in FIG. 1.
Figure 3:
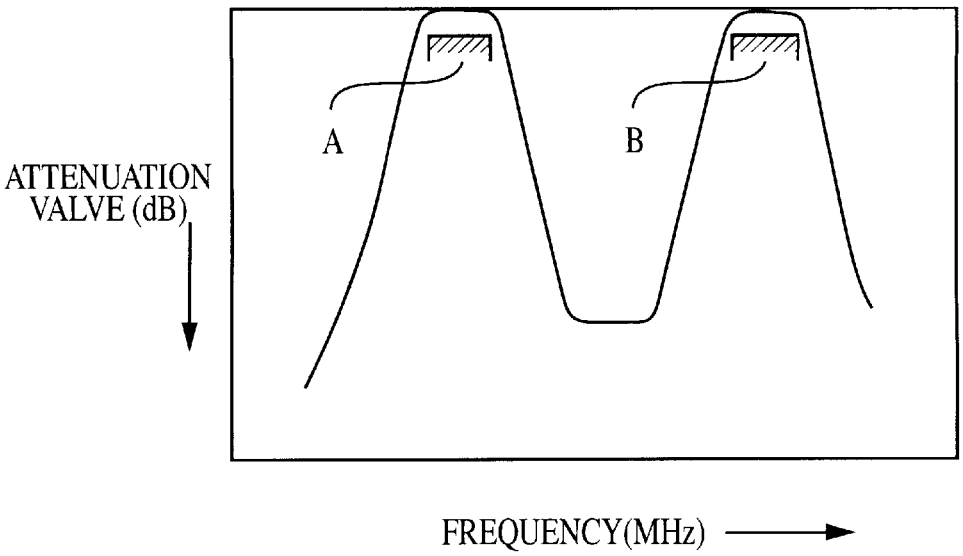
FIG. 3 is a graph to indicate the attenuation characteristic of the dielectric filter illustrated in FIG. 1.

[First Preferred Embodiment, FIG. 1 through FIG. 3]

As illustrated in FIG. 1, a dielectric filter 1 is provided with a rectangular parallelepiped dielectric block 2 made of dielectric material. A plurality of through holes 3 (two holes in the first embodiment) extending between a first surface 2*a* and a second surface 2*b* which is opposed to the first surface 2*a* of the dielectric block 2. Inner conductor 4 are provided respectively on inner wall surfaces of the through holes 3, and the inner conductors 4 are provided with non-conductive portions 4*a* in the vicinity of the first surface 2*a*.

An outer conductors 5 is provided on an outer wall surface of the dielectric block 2 except for the first surface 2*a*. That is, the outer conductor 5 is electrically opened (disconnected) from the inner conductors 4 at the first surface 2*a* (hereinafter, referred to as "the open end surface 2*a*") of the dielectric block 2, and electrically short-circuited (connected) to the inner conductors 4 at the second surface 2*b* (hereinafter, referred to as "the short-circuited end surface 2*b*").

Further, a line conductor 7 leading from third surface 5*a* of the dielectric block 2 to the fourth surface 5*b* is provided on the open end surface 2*a* between the through holes 3. The line conductor 7 electrically connects an outer conductor portion provided on the upper surface (third surface) 5*a* of the dielectric block 2 to an outer conductor portion provided on the lower surface (fourth surface) 5*b* thereof on the open end surface 2*a*. A TE mode input electrode 11*a*, a TEM mode input electrode 12*a*, a TE mode output electrode 11*b*, and a TEM mode output electrode 12*b* are formed respectively on right and left side surfaces (fifth and sixth surfaces) of the dielectric block 2 with a gap between them and the outer conductors 5.

Two through holes 3 and their inner conductors 4, together with the outer conductors 5 and the dielectric block 2, constitute two TEM mode dielectric resonators 16*a*, 16*b* of ¼ wavelength with the open end surface 2*a* and the short-circuited end surface 2*b* of the dielectric block 2 as the open surface and the short-circuited surface. The TEM mode dielectric resonators 16*a*, 16*b* are electromagnetically coupled with each other to form a two-stage band pass filter of the TEM mode.

The line conductor 7 provided on the open end surface 2*a* of the dielectric block 2 works as the coupling susceptance. Thus, the outer conductor 5 and the dielectric block 2 constitute two TE mode dielectric resonators 15*a*, 15*b* (preferably of the mode of low order such as $TE_{101}$,$TE_{102}$) divided by the line conductor 7. The TE mode dielectric resonators 15*a*, 15*b* are electromagnetically coupled with each other through the line conductor 7 to form a two-stage band pass filter of the TE mode. That is, the line conductor 7 not only electromagnetically couples the dielectric resonators 15*a*, 15*b* of the TE mode, but also functions as an electromagnetic boundary part with a large reflection coefficient for the resonators 15*a*, 15*b*.

FIG. 2 is an electric equivalent circuit of the dielectric filter 1. The dielectric filter 1 is a dual band dielectric filter of two-input and two-output in which the TEM mode band pass filter and the TE mode band pass filter are built in. That is, as illustrated in FIG. 3, the dielectric filter 1 has two pass bands, and for example, the pass band A is the pass band of the TEM mode band pass filter while the pass band B is the pass band of the TE mode band pass filter.

In the dielectric filter 1 of the above-mentioned construction, the inner conductor 4 provided in each through hole 3 is provided with the non-conductive portion 4*a*, and the respective resonance frequencies of the TEM mode dielectric resonators 16*a*, 16*b* and the electromagnetic coupling therewith can be regulated by appropriately setting the dimensions and the arrangement positions of the non-conductive portion 4*a*. Thus, the band pass width and the center frequency of the TEM mode band pass filter can be changed.

On the other hand, the electromagnetic coupling between the TE mode dielectric resonators 15*a*, 15*b* can be regulated by appropriately setting the number and dimensions of the line conductor 7 provided on the open end surface 2*a* of the dielectric block 2 or the arrangement position, etc., on the open end surface 2*a*. Thus, the band pass width and the center frequency of the TE mode band pass filter can be changed.

Thus, in the dielectric filter 1, an electromagnetic effect of the line conductor 7 formed on the open end surface 2*a* is suppressed, because the non-conductive portion 4*a* is provided in the through hole 3 to regulate the respective resonance frequencies of the TEM mode dielectric resonators 16*a*, 16*b* and the electromagnetic coupling therewith. Further, no electrode pattern is formed on the open end surface 2*a* of the dielectric block 2 except the line conductor 7, so that there is no strict limitation on the position for forming the line conductor 7, and the degree of freedom in setting the resonance frequencies of the TE mode dielectric resonators 15*a*, 15*b* is high. As a result, a compact dielectric filter 1 structure comprising an independently designed TEM mode band pass filter and TE mode band pass filter can be obtained.

Figure 4:
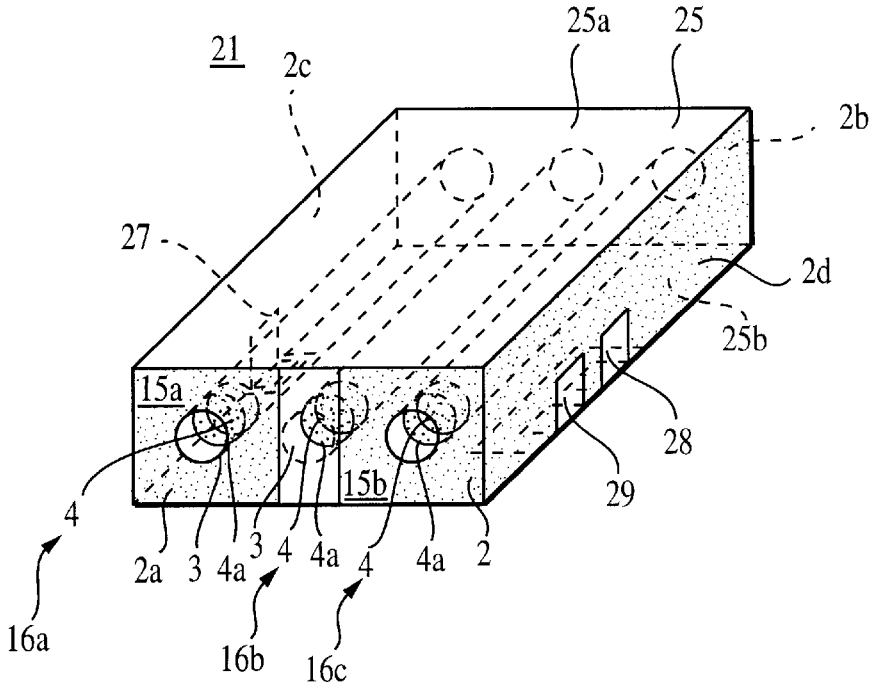
FIG. 4 is a perspective view illustrating a second preferred embodiment of the dielectric filter of the present invention.
Figure 5:
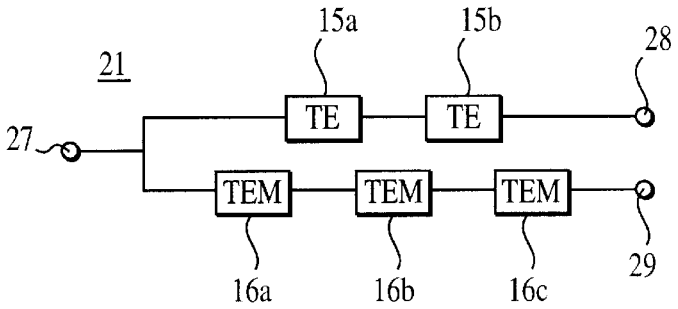
FIG. 5 is an electric equivalent circuit of the dielectric filter illustrated in FIG. 4.

[Second Preferred Embodiment, FIG. 4 and FIG. 5]

As illustrated in FIG. 4, in a dielectric filter 21, three through holes 3 extending between an open end surface (a first surface) 2*a* and a short-circuited end surface (a second surface) 2*b* are formed in the dielectric block 2. Each inner conductor 4 is formed on the inner wall surface of a respective through hole 3, and each inner conductors 4 is provided with a non-conductive portion 4*a* near the open end surface 2*a*. The outer conductor 25 is formed on the outer wall surface of the dielectric block 2 except the open end surface 2*a* and right and left side surfaces 2*c*, 2*d*.

A line conductor 7 is provided on the open end surface 2*a* and overlaps the through hole 3 located at the center. The line conductor 7 electrically connects an outer conductor part 25*a* provided on the upper surface (third surface) of the dielectric block 2 to an outer conductor portion 25*b* provided on the lower surface (fourth surface) on the open end surface 2*a*. An input electrode 27 common to the TE mode and the TEM mode, a TE mode output electrode 28, and a TEM mode output electrode 29 are provided on the right and left side surfaces (fifth and sixth surfaces) 2*c*,2*d* of the dielectric block 2 with a gap to an outer conductor 25.

Three through holes 3 and their inner conductors 4 constitute three TEM mode dielectric resonators 16*a*, 16*b*, 16*c* of ¼ wavelength together with the outer conductor 25 and the dielectric block 2. The TEM mode dielectric resonators 16*a*–16*c* are electromagnetically coupled with each other to form the three-stage band pass filter of TEM mode. The outer conductor 5 and the dielectric block 2 constitute two TE mode dielectric resonators 15*a*, 15*b* divided by the line conductor 7.

FIG. 5 is an electric equivalent circuit of the dielectric filter 21. The dielectric filter 21 is a dual-band dielectric filter of one-input/two-output type in which the TEM mode band pass filter, and the TE mode band pass filter are built in.

The dielectric filter 21 the above-mentioned construction functions similarly the similar to that effect of the dielectric filter 1 in the first preferred embodiment, and functions as an electromagnetic wall of large reflection coefficient because no outer conductors are formed on the right and left side surfaces 2*c*,2*d* of the dielectric block 2. Thus, the TE mode dielectric resonators 15*a*, 15*b* can be miniaturized, and the size of the dielectric block 2 can be reduced. Further, even through the line conductor 7 overlaps the through hole 3 on the open end surface 2*a*, the inner conductors 4 are provided with the non-conductive portion 4*a* in the vicinity of the open end surface 2*a*, so that there is no concern that the open surface of the TEM mode dielectric resonator 16*b* is short-circuited by the line conductor 7. Thus, the position for forming the line conductor 7 is not limited on the open end surface 2*a*, and the degree of freedom of setting the resonance frequency of the TE mode dielectric resonators 15*a*, 15*b* is high.

Figure 6:
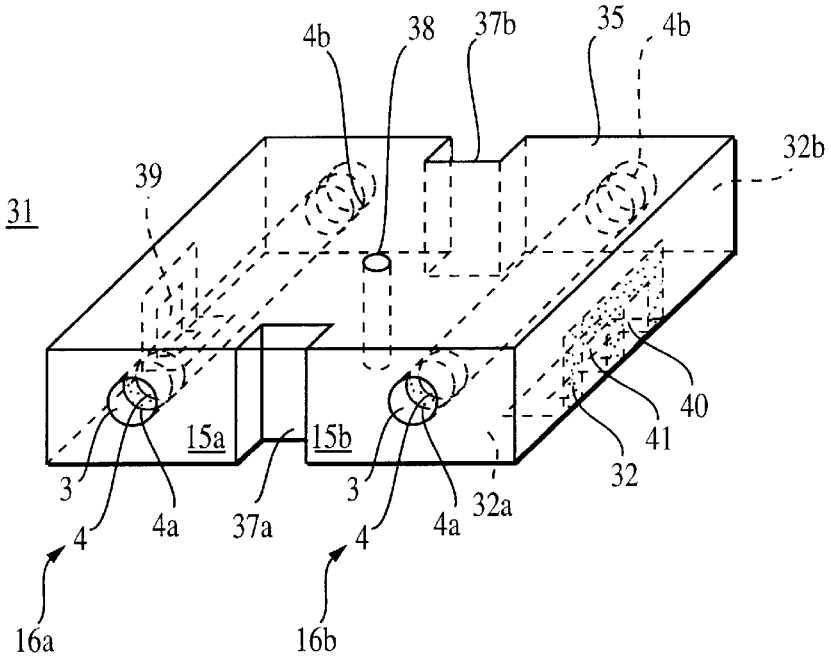
FIG. 6 is a perspective view illustrating a third preferred embodiment of the dielectric filter of the present invention.
Figure 7:
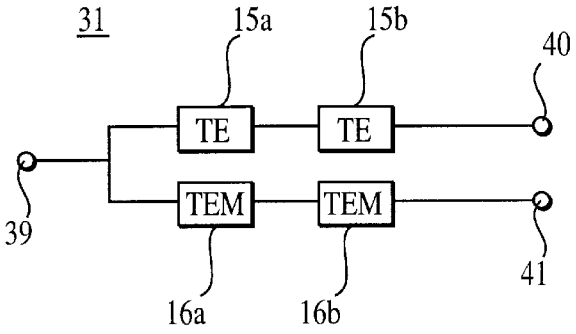
FIG. 7 is an electric equivalent circuit of the dielectric filter illustrated in FIG. 6.

[Third Preferred Embodiment, FIG. 6 and FIG. 7]

As illustrated in FIG. 6, a dielectric filter 31 is provided with an approximately rectangular parallelepiped dielectric block 32. Two through holes 3 extending between an open end surface 32*a* and an open end surface 32*b* are provided respectively in right and left side portions of the dielectric block 32. The inner conductors 4 are provided respectively on the inner wall surface of the through holes 3, and the inner conductors 4 are provided with the non-conductive portions 4*a*, 4*b* in the vicinity of the open end surface 32*a* and in the vicinity of the open end surface 32*b*.

Grooves 37*a*,37*b* for coupling are provided opposite to each other in center portions of the open end surfaces 32*a*,32*b* of the dielectric block 32. The grooves 37*a*, 37*b* for coupling are extended from the upper surface to the lower surface of the dielectric block 32. In addition, a hole 38 for coupling is provided in the center part of the dielectric block 32, i.e., between the grooves 37*a*, 37*b* for coupling. An inner conductor is provided on the inner wall surface of the hole 38 for coupling.

An outer conductor 35 is provided on substantially the entire outer wall surface of the dielectric block 32. The outer conductor 35 is provided on the wall surfaces of the grooves 37*a*, 37*b* for coupling, and the inner conductor of the hole 38 for coupling is connected to the outer conductor 35 at each end. An input electrode 39 common to the TE mode and the TEM mode, a TE mode output electrode 40, and a TEM mode output electrode 41 are formed with a gap from the outer conductor 35.

Two through holes 3 and their inner conductors 4 constitute two TEM mode dielectric resonators 16*a*, 16*b* of ½ wavelength with the open end surface 32*a* and the open end surface 32*b* of the dielectric block 32 being open together with the outer conductor 35 and the dielectric block 32. The TEM mode dielectric resonators 16*a*, 16*b* are electromagnetically coupled with each other to constitute the two-stage band pass filter of TEM mode.

Grooves 37*a*, 37*b* for coupling provided on the dielectric block 32, and the through hole 38 in which inner conductor is provided, operate as the coupling susceptance. Thus, the outer conductor 35 and the dielectric block 32 constitute two TE mode dielectric resonators 15*a*, 15*b* divided by the grooves 37*a*,37*b* for coupling and the through hole 38. The TE mode dielectric resonators 15*a*, 15*b* are electromagnetically coupled with each other through a part narrowed by the grooves 37*a*, 37*b* for coupling of the dielectric block 32 and the hole 38 for coupling to form a two-stage band pass filter of TE mode. That is, the grooves 37*a*, 37*b* for coupling and the hole 38 for coupling not only electromagnetically couple the TE mode dielectric resonators 15*a*, 15*b*, but also function as electromagnetic boundary parts of large reflection coefficient of the resonators 15*a*, 15*b*. Neither the grooves 37*a*, 37*b* for coupling nor the through hole 38 is necessarily provided, and similar effect can be obtained with a device provided with either of the grooves 37*a*, 37*b* for coupling or the through hole 38.

FIG. 7 is an electric equivalent circuit of the dielectric filter 31. The dielectric filter 31 is a dual band dielectric filter of one-input/two-output type in which the TEM mode band pass filter and the TE mode band pass filter are built.

In the dielectric filter 31 of the above-mentioned construction, the inner conductors 4 provided on the respective through holes 3 are provided with non-conductive portions 4*a*, 4*b*, and the respective resonance frequencies of the TEM mode dielectric resonators 16*a*, 16*b* and the electromagnetic coupling therewith can be regulated by appropriately setting the dimensions and the arrangement position of the non-conductive portions 4*a*, 4*b*. Thus, the pass band width, the center frequency, etc., of the TEM mode band pass filter can be changed.

On the other hand, the electromagnetic coupling between the TE mode dielectric resonators 15*a*, 15*b* can be regulated by appropriately setting the number, dimensions or arrangement position of the grooves 37*a*, 37*b* for coupling which are respectively provided on the open end surfaces 32*a*, 32*b* of the dielectric block 32, and the through hole 38 for coupling provided in the center pat of the dielectric block 32. Thus, the pass band width and the center frequency of the TE mode band pass filter can be changed.

Because the dielectric filter 31 is provided with the non-conductive portions 4*a*, 4*b* to regulate the respective resonance frequencies of the TEM mode dielectric resonators 16*a*, 16*b* and the electromagnetic coupling therewith in the through holes 3, an electromagnetic affection by the open end surfaces 32*a*,32*b*, the grooves 37*a*,37*b* for coupling and the through hole 38 for coupling which are provided in the center part of the dielectric block 32 is suppressed. As a result, the dielectric filter 31 having an independent TEM mode band pass filter and TE mode band pass filter can be obtained.

Figure 8:
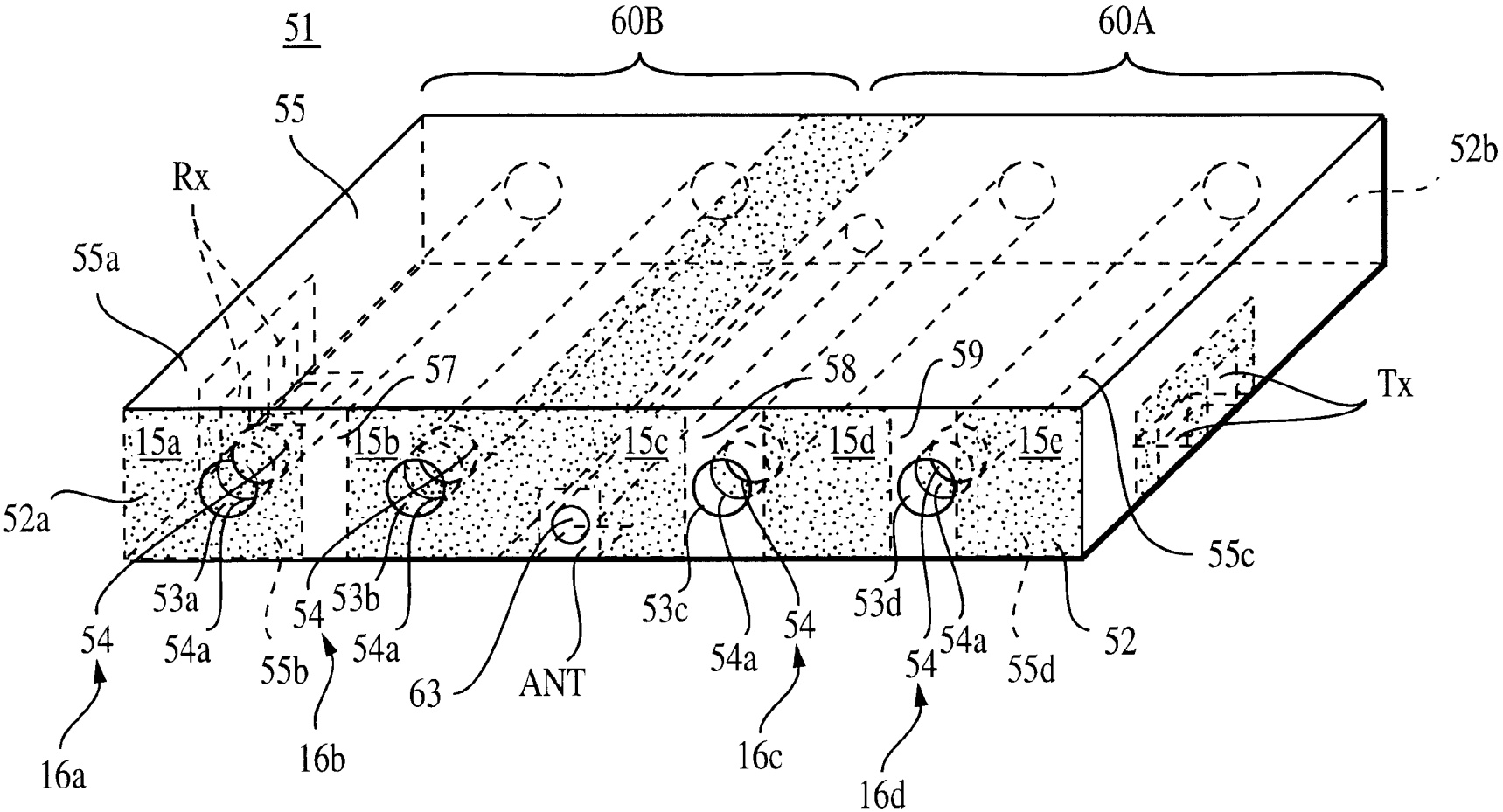
FIG. 8 is a perspective view illustrating an preferred embodiment of a dielectric duplexer of the present invention.
Figure 9:
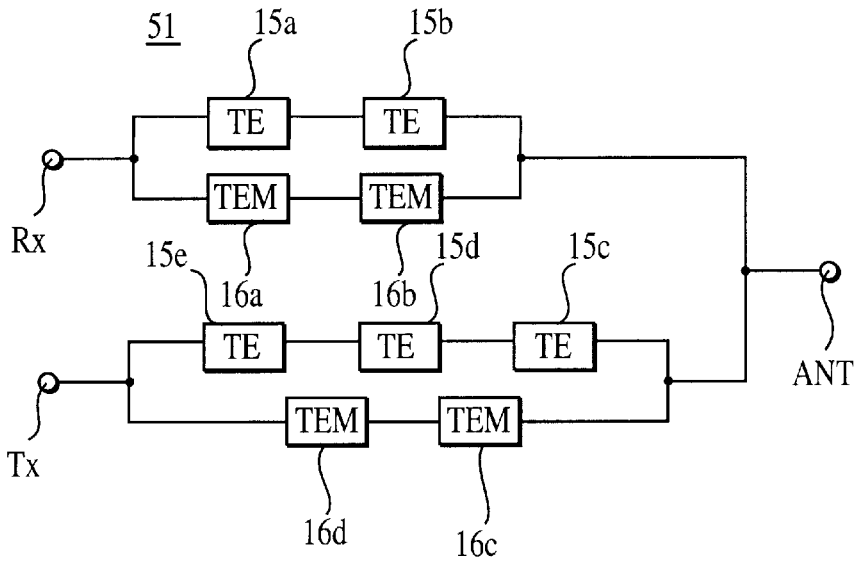
FIG. 9 is an electric equivalent circuit of the dielectric duplexer illustrated in FIG. 8.
Figure 10:
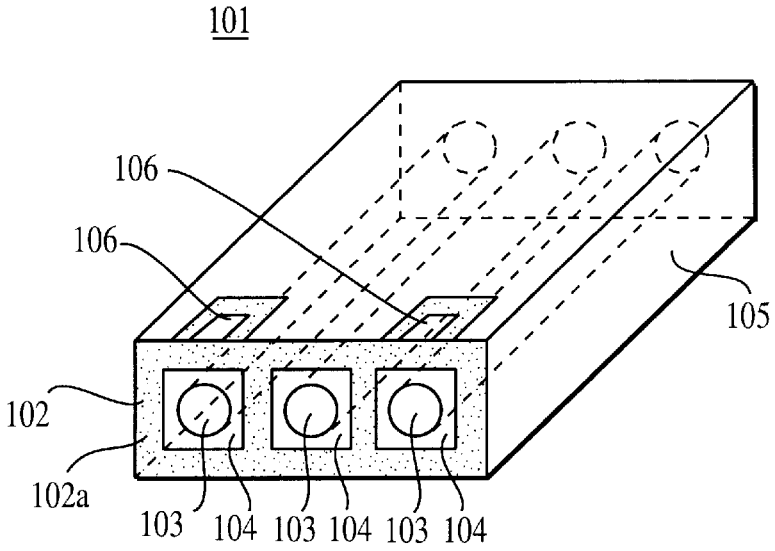
FIG. 10 PRIOR ART
FIG. 10 is a perspective view illustrating a dielectric filter of the conventional TEM mode.
Figure 11:
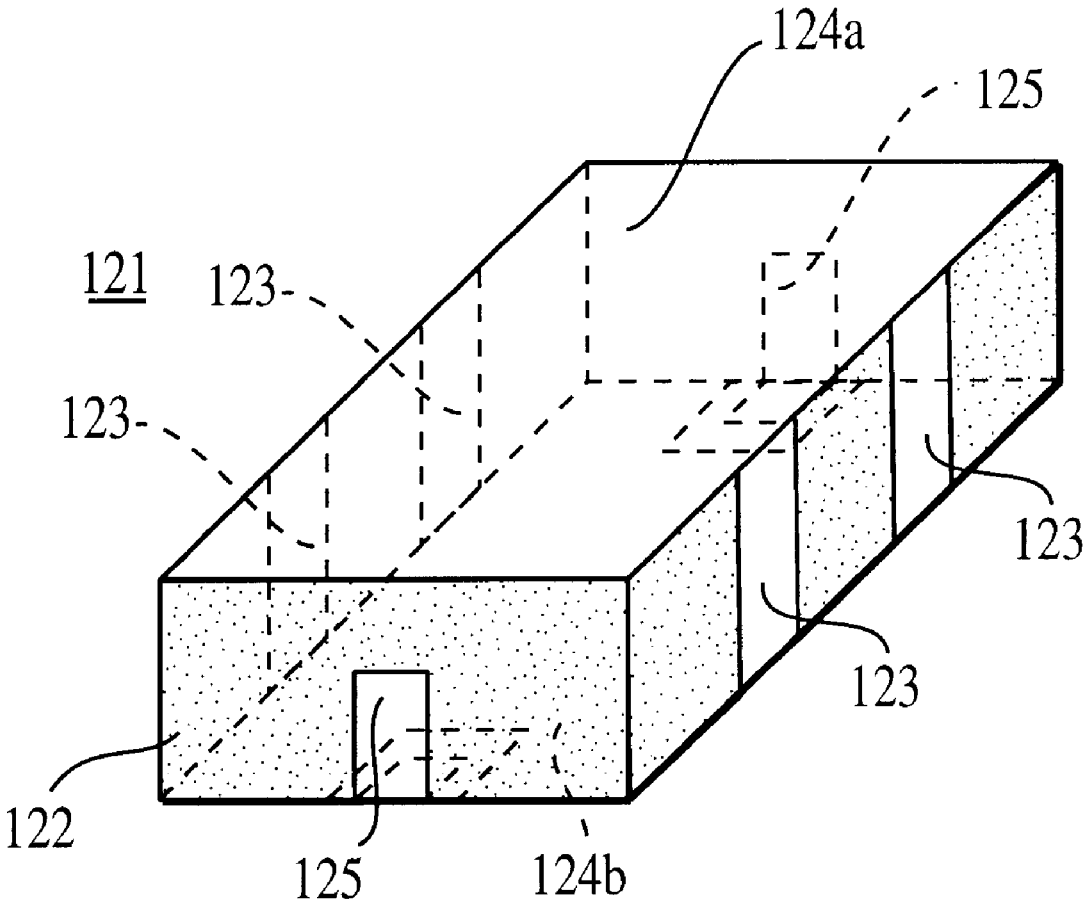
FIG. 11 PRIOR ART
FIG. 11 is a perspective view illustrating a dielectric filter of the conventional TE mode.

[Fourth Preferred Embodiment, FIG. 8 and FIG. 9]

A fourth preferred embodiment describes a dielectric duplexer for use in a mobile communication equipment such as a mobile phone and a portable phone. As illustrated in FIG. 8, the dielectric filter 51 is provided with a rectangular parallelepiped dielectric block 52 made of the dielectric material. Four through holes 53*a*, 53*b*, 53*c*, 53*d* extending between an open end surface 52*a* and an open end surface 52*b* are provided in a row in the dielectric block 52. Inner conductors 54 are formed respectively on the inner wall surface of the through holes 53*a*–53*d*, and the inner conductors 54 are provided with non-conductive portions 54*a* on the open end surface 52*a* side. In addition, an outer coupling hole 63 extending between a center part of the open end surface 52*a* of the dielectric block 52 and a center part of the open end surface 52*b* is provided between the through holes 53*b*, 53*c*. An inner conductor is are provided on the inner wall surface of the outer coupling hole 63.

An outer conductor 55 is provided on an outer wall surface of the dielectric block 52 except for the open end surface 52*a*. That is, in the outer conductor 55, outer conductor portions 55*a*, 55*c* are provided on the right half and the left half separated by a gap on the upper surface of the dielectric block 52, while outer conductor parts 55*b*, 55*d* are provided on the right half and the left half separated by the prescribed gap on the lower surface of the dielectric block 52. The outer conductor 55 is electrically opened (disconnected) from the inner conductors 4 of the through holes 53*a*–53*d* on the open end surface 52*a* of the dielectric block 52, and electrically short-circuited(conducted) with the inner conductors 4 on the short-circuit side end surface 52*b*.

A line conductor 57 leading from an upper surface of the dielectric block 52 to the lower surface thereof is provided on the open end surface 52*a* between through holes 53*a*, 53*b*, and line conductors 58, 59 leading from the upper surface to the lower surface of the dielectric block 52 are provided on the open end surface 52*a* and overlap through holes 53*c*, 53*d*. The line conductor 57 electrically connects the outer conductor portion 55*a* provided on the upper surface of the dielectric block 52 to the outer conductor 55*b* provided on the lower surface on the open end surface 52*a*. The line conductors 58, 59 respectively and electrically connect an outer conductor part 55*c* provided on the upper surface of the dielectric block 52 to an outer conductor part 55*d* provided on the lower surface thereof on the open end surface 52*a*.

A receiving electrode Rx and a transmission electrode Tx which are input electrodes common to the TE mode and the TEM mode are provided on right and left side parts of the dielectric block 52 with a gap to the outer conductor 55. An antenna electrode ANT which is an input electrode common to the TE mode and the TEM mode is provided in the center portion of the open end surface 52*a* of the dielectric block 52 in a conducted manner to the inner conductor in an outer coupling hole 63. That is, the inner conductor in the outer coupling hole 63 is electrically disconnected to the outer conductor 55 on the open end surface 52*a*, and electrically conducted with the outer conductor 55 on the short-circuited end surface 52*b*.

Two through holes 53*a*, 53*b* and their inner conductors 54 constitute two TEM mode dielectric resonators 16*a*, 16*b* of ¼ wavelength with the open end surface 52*a* and the short-circuit side end surface 52*b* of the dielectric block 52 being the open surface and the short-circuit surface together with the respective left halves of the outer conductor 55 and the dielectric block 52. The TEM mode dielectric resonators 16*a*, 16*b* are electromagnetically coupled with each other to form the two-stage band pass filter of TEM mode.

The line conductor 57 provided on the open end surface 52*a* of the dielectric block 52 functions as the coupling susceptance. Thus, the respective left halves of the outer conductor 55 and the dielectric block 52 constitute two TE mode dielectric resonators 15*a*, 15*b* divided by the line conductor 57. The TE mode dielectric resonators 15*a*, 15*b* are electromagnetically coupled with each other through the line conductor 57 to form the two-stage band pass filter of the TE mode. That is, the line conductor 57 not only electromagnetically couples the TE mode dielectric resonators 15*a*, 15*b*, but also functions as an electromagnetic boundary part of large reflection coefficient of the resonators 15*a*, 15*b*.

Two through holes 53*c*, 53*d* and their inner conductors 54 constitute two TEM mode dielectric resonators 16*c*, 16*d* of ¼ wavelength with the open end surface 52*a* and the short-circuit side end surface 52*b* of the dielectric block 52 being the open surface and the short-circuit surface together with the respective right halves of the outer conductor 55 and the dielectric block 52. The TEM mode dielectric resonators 16*c*, 16*d* are electromagnetically coupled with each other to form the two-stage band pass filter of the TEM mode.

The line conductors 58, 59 provided on the open end surface 52*a* of the dielectric block 52 function as the coupling susceptance. Thus, the respective right halves of the outer conductor 55 and the dielectric block 52 constitute three TE mode dielectric resonators 15*c*, 15*d*, 15*e* divided by the line conductors 58, 59. The TE mode dielectric resonators 15*c*-15*e* are electromagnetically coupled with each other through the line conductors 58,59 to form a three-stage band pass filter of the TE mode.

In the dielectric duplexer 51 of the above-mentioned construction, the resonators 15*c*–15*e*, 16*c*, 16*d* arranged on the right half of the dielectric block 52 form a transmission filter 60A. The resonators 15*a*, 15*b*, 16*a*, 16*b* arranged on, the left half of the dielectric block 52 form a transmission filter 60B. The dielectric duplexer 51 outputs the transmission signal received by the transmission electrode Tx from the transmission circuit system not shown in the figure from the antenna electrode ANT through the transmission filter 60A, and outputs the reception signal received by the antenna electrode ANT from the receiving electrode Rx to the reception circuit system not shown in the figure through the reception filter 60B. FIG. 9 is an electric equivalent circuit of the dielectric duplexer 51.

In the dielectric duplexer 51, the inner conductors 54 provided in the through holes 53*a*–53*d* are provided with the non-conductive portion 54*a*, and the respective resonance frequencies of the TEM mode dielectric resonators 16*a*–16*d* and the electromagnetic coupling therewith can be regulated by appropriately setting the dimension and the arrangement position of the non-conductive portion 54*a*. Thus, the pass band width and the center frequency of the TEM mode band pass filter can be changed. On the other hand, the electromagnetic coupling of the TE mode dielectric resonators 15*a*–15*e* therewith can be regulated by appropriately setting the number and dimensions of the line conductors 57–59 provided on the open end surface 52*a* of the dielectric block 52 and the arrangement position on the open end surface 52*a*. Thus, the pass band width and the center frequency of the TE mode band pass filter can be changed.

The dielectric duplexer 51 is provided with the non-conductive portion 54*a* to regulate the respective resonance frequencies of the TEM mode dielectric resonators 16*a*–16*d* and the electromagnetic coupling therewith in the through holes 53*a*–53*d*, and electromagnetically affected with difficulty by the line conductors 57–59 to regulate the electromagnetic coupling between the TE mode dielectric resonators formed on the open end surface 52*a*. Further, on the open end surface 52*a* of the dielectric block 52, the limit of the forming position of the line conductors 57–59 is not strict, and the degree of freedom in setting the resonance frequencies of the TE mode dielectric resonators 15*a*–15*e* is high. As a result, a compact dielectric duplexer 51 capable of having an independent TEM mode band pass filter and TE mode band pass filter can be obtained.

[Other Preferred Embodiments]

The dielectric filter and the dielectric duplexer of the present invention are not limited to the above-mentioned embodiments, but can be variously changed in the scope of the subject matter of the present invention.

In the above-described embodiments, the dielectric filter and the dielectric duplexer in which the TEM mode band pass filter and the TE mode band pass filter are built, are described. However, because the structure of the TE mode band pass filter is same as the structure of the TM mode band pass filter, the dielectric filter and the dielectric duplexer in each embodiment can be handled as the dielectric filter and the dielectric duplexer in which the TM mode band pass filter and the TE mode band pass filter are built by inputting the TM mode signal in place of the TE mode.

Further, in the dielectric duplexer 51 in the fourth preferred embodiment, a through hole for coupling or a groove for coupling may be provided in place of the line conductors 57–59, and the inner conductors 54 in the through holes 53*a*–53*d* may have an non-conductive portion also in the vicinity of the short-circuit side end surface 52*b*.

While the invention has been particularly shown and described with reference to preferred embodiments thereof, it will be understood by those skilled in the art that the foregoing and other changes in form and details may be made therein without departing from the spirit of the invention.

What is claimed is:

1. A dielectric filter, comprising:

a dielectric block having substantially rectangular shape, said dielectric block including first and second surfaces opposed to each other, third and fourth surfaces opposed to each other and extending between said first and second surfaces, and fifth and sixth surfaces opposed to each other and extending between said first and second surfaces;

a plurality of through holes extending between said first and second surfaces;

an inner conductor provided on a respective inner surface of each of said through holes except for a non-conductive portion, each said non-conductive portion being disposed on said inner surface of the corresponding said through hole in the vicinity of said first surface of said dielectric block;

an outer conductor provided on said third and fourth surfaces of said dielectric block; and a line conductor provided on said first surface of said dielectric block, a part of said outer conductor provided on said third surface of said dielectric block and a part of said outer conductor provided on said fourth surface of said dielectric block being connected to each other via said line conductor;

thereby a plurality of resonators comprising a combination of a TEM mode resonator and a TE mode resonator, or a combination of a TEM mode resonator and a TM mode resonator being provided;

at least three input/output external electrodes being provided on said fifth and sixth surfaces of said dielectric block; said input/output external electrodes including either: a TE or TM mode input electrode and a TEM mode input electrode, or a TE or TM mode output electrode and a TEM mode output electrode.

2. A dielectric filter, comprising:

a dielectric block having substantially rectangular shape, said dielectric block including first and second surfaces opposed to each other, third and fourth surfaces opposed to each other and extending between said first and second surfaces, and fifth and sixth surfaces opposed to each other and extending between said first and second surfaces;

a plurality of through holes extending between said first and second surfaces;

an inner conductor provided on a respective inner surface of each of said through holes except for a non-conductive portion, each said non-conductive portion being disposed on said inner surface of the corresponding said through hole in the vicinity of said first surface of said dielectric block;

an outer conductor provided on said third and fourth surfaces of said dielectric block; and at least one coupling structure selected from the group consisting of: (1) a coupling hole extending between said third and fourth surfaces of said dielectric block, a part of said outer conductor provided on said third surface of said dielectric block and a part of said outer conductor provided on said fourth surface of said dielectric block being connected to each other via said coupling hole; and (2) a coupling groove disposed on said first and second surfaces of said dielectric block and extending in a direction defined between said third and fourth surfaces of said dielectric block;

thereby a plurality of resonators comprising a combination of a TEM mode resonator and a TE mode resonator, or a combination of a TEM mode resonator and a TM mode resonator being provided;

at least three input/output external electrodes being provided on said fifth and sixth surfaces of said dielectric block; said input/output external electrodes including either: a TE or TM mode input electrode and a TEM mode input electrode, or a TE or TM mode output electrode and a TEM mode output electrode.

3. The dielectric filter according to claim 2, wherein said non-conductive portion is also disposed on said inner surface of said through holes in the vicinity of said second surface of said dielectric block.

4. A dielectric duplexer, comprising:

a dielectric block having substantially rectangular shape, said dielectric block including first and second surfaces opposed to each other, third and fourth surfaces opposed to each other and extending between said first and second surfaces, and fifth and sixth surfaces opposed to each other and extending between said first and second surfaces;

a plurality of through holes extending between said first and second surfaces;

an inner conductor provided on a respective inner surface of each of said through holes except for a non-conductive portion, each said non-conductive portion being disposed on said inner surface of the corresponding said through hole in the vicinity of said first surface of said dielectric block;

an outer conductor provided on said third and fourth surfaces of said dielectric block; and a line conductor provided on said first surface of said dielectric block, a part of said outer conductor provided on said third surface of said dielectric block and a part of said outer conductor provided on said fourth surface of said dielectric block being connected to each other via said line conductor;

thereby a plurality of resonators comprising a combination of a TEM mode resonator and a TE mode resonator, or a combination of a TEM mode resonator and a TM mode resonator being provided;

at least three input/output external electrodes being provided on said fifth and sixth surfaces of said dielectric block; said input/output external electrodes including either: a TE or TM mode input electrode and a TEM mode input electrode, or a TE or TM mode output electrode and a TEM mode output electrode.

5. A dielectric duplexer, comprising:

a dielectric block having substantially rectangular shape, said dielectric block including first and second surfaces opposed to each other, third and fourth surfaces opposed to each other and extending between said first and second surfaces, and fifth and sixth surfaces opposed to each other and extending between said first and second surfaces;

a plurality of through holes extending between said first and second surfaces;

an inner conductor provided on a respective inner surface of each of said through holes except for a non-conductive portion, each said non-conductive portion being disposed on said inner surface of the corresponding said through hole in the vicinity of said first surface of said dielectric block;

an outer conductor provided on said third and fourth surfaces of said dielectric block; and at least one coupling structure selected from the group consisting of: (1) a coupling hole extending between said third and fourth surfaces of said dielectric block, a part of said outer conductor provided on said third surface of said dielectric block and a part of said outer conductor provided on said fourth surface of said dielectric block being connected to each other via said coupling hole; and (2) a coupling groove disposed on said first and second surfaces of said dielectric block and extending in a direction defined between said third and fourth surfaces of said dielectric block;

thereby a plurality of resonators comprising a combination of a TEM mode resonator and a TE mode resonator, or a combination of a TEM mode resonator and a TM mode resonator being provided;

at least three input/output external electrodes being provided on said fifth and sixth surfaces of said dielectric block; said input/output external electrodes including either: a TE or TM mode input electrode and a TEM mode input electrode, or a TE or TM mode output electrode and a TEM mode output electrode.

6. The dielectric duplexer according to claim 5, wherein said non-conductive portion is also disposed on said inner surface of said through holes in the vicinity of said second surface of said dielectric block.

* * * * *